US010407976B1

(12) United States Patent
Kelley

(10) Patent No.: US 10,407,976 B1
(45) Date of Patent: Sep. 10, 2019

(54) GARAGE DOOR PANEL

(71) Applicant: Robert A. Kelley, Moreno Valley, CA (US)

(72) Inventor: Robert A. Kelley, Moreno Valley, CA (US)

( * ) Notice: Subject to any disclaimer, the term of this patent is extended or adjusted under 35 U.S.C. 154(b) by 0 days.

(21) Appl. No.: 15/841,035

(22) Filed: Dec. 13, 2017

(51) Int. Cl.

| | |
|---|---|
| ***E06B 3/00*** | (2006.01) |
| ***E06B 3/70*** | (2006.01) |
| ***E06B 5/20*** | (2006.01) |
| *B21D 5/00* | (2006.01) |

(52) U.S. Cl.
CPC ..... *E06B 3/7015* (2013.01); *E06B 3/7001* (2013.01); *E06B 5/20* (2013.01); *B21D 5/002* (2013.01); *E06B 2003/7023* (2013.01); *E06B 2003/7044* (2013.01); *E06B 2003/7051* (2013.01)

(58) Field of Classification Search
CPC ..... E06B 3/7015; E06B 2003/7051; E06B 3/7001; E06B 5/20; E06B 2003/7023; E06B 2003/7044; B21D 5/002
See application file for complete search history.

(56) References Cited

U.S. PATENT DOCUMENTS 4,779,325 A * 10/1988 Mullet ..... E04C 2/292 29/460
5,435,108 A * 7/1995 Overholt ..... E04C 2/292 160/236
5,787,677 A * 8/1998 Bolich ..... B32B 11/10 52/784.15
6,578,619 B2 * 6/2003 Wright ..... E05D 15/24 160/229.1
6,629,387 B2 * 10/2003 Whitley ..... E05D 15/165 160/201
7,900,682 B2 * 3/2011 Calvino, Jr. ..... E06B 3/485 160/232
8,590,244 B2 * 11/2013 O'Riordan ..... E06B 3/485 160/229.1
8,640,414 B2 * 2/2014 Reyes, II ..... E06B 3/485 160/219
2006/0254730 A1 * 11/2006 Wood ..... E06B 3/485 160/236
2007/0272371 A1 * 11/2007 Reyes ..... E06B 3/485 160/201
2014/0260080 A1 * 9/2014 Swartzmiller ..... E06B 3/72 52/784.1

* cited by examiner

*Primary Examiner* — Beth A Stephan
(74) *Attorney, Agent, or Firm* — Thomas I. Rozsa

(57) ABSTRACT

An apparatus for a garage door panel which includes a formed metal section with at least one decorative portion on the front surface and having a rear surface. The formed metal section including a top portion with a male tongue and a bottom portion with a female groove. The garage door panel includes an insert combination of a polystyrene section and twin wall polypropylene section. The rear surface of the formed metal section is spray coated with a combination isocyanate and polyol resin which combines to form as hardened polyurethane foam section. The front surface of the polystyrene section is retained against the polyurethane foam section and the rear surface of the twin wall polypropylene serves as the rear surface of the garage door panel. Two metal stiles are respectively affixed at the left or first end and the right or second end.

20 Claims, 12 Drawing Sheets

GARAGE DOOR PANEL

BACKGROUND OF THE INVENTION

1. Field of the Invention

This invention relates to the field of garage doors. Specifically, this invention relates to garage door paneling and an improvement for the paneling that is used in garage doors.

2. Description of the Prior Art

The inventor is not aware of any prior art patents or published patent applications which either identically disclose or make obvious the invention disclosed and claimed in the present patent application.

SUMMARY OF THE INVENTION

The present invention is an apparatus patent for a garage door panel which is comprised of a formed metal section with at least one decorative portion which is indented into the front surface leaving raised areas on the rear surface, the formed metal section including a top portion with a male tongue and a bottom portion with a female groove. The key innovation is the backing material which includes a polystyrene section having a front surface and a rear surface and an identically sized and shaped twin wall polypropylene section having a front surface and a rear surface. The front surface of the twin wall polypropylene is affixed by adhesive such as glue to the rear surface of the polystyrene section to form the combination. The rear surface of the formed metal section is spray coated with a combination isocyanate and polyol resin which combines to form as hardened polyurethane foam section. The front surface of the polystyrene section is retained against the polyurethane foam section and the rear surface of the twin wall polypropylene serves as the rear surface of the garage door panel. A metal stile is affixed at the left end and the right end to retain the components together and provide a secure structure. For panels longer than eight (8) feet, one or more intermediate stiles are used.

The present invention also includes the method of making the panel.

It is an object of the present invention to provide a lightweight, noise reducing garage door panel that has only one side covered by metal.

It is an additional object of the present invention to provide a rigid, monolithic garage door panel that contains a polystyrene center that is retained to a corrugated twin wall polypropylene section by hot melt glue or other standard affixing means.

It is a further object of the present invention to provide a garage door panel that contains a polystyrene center that is retained to an outer metal covering by a polypropylene section with the polypropylene section formed from two chemicals that are initially in liquid form. The two chemicals harden into a rigid foam after approximately 90 seconds to retain the polystyrene center to the rear surfaced of the outer metal covering.

It is still a further object of the present invention to provide a method for constructing a lightweight rigid garage door panel that only requires one side of the panel to be made of metal. This method includes a metal sheet that is rolled out to a desired length and then cut to form the outer metal covering of the panel.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
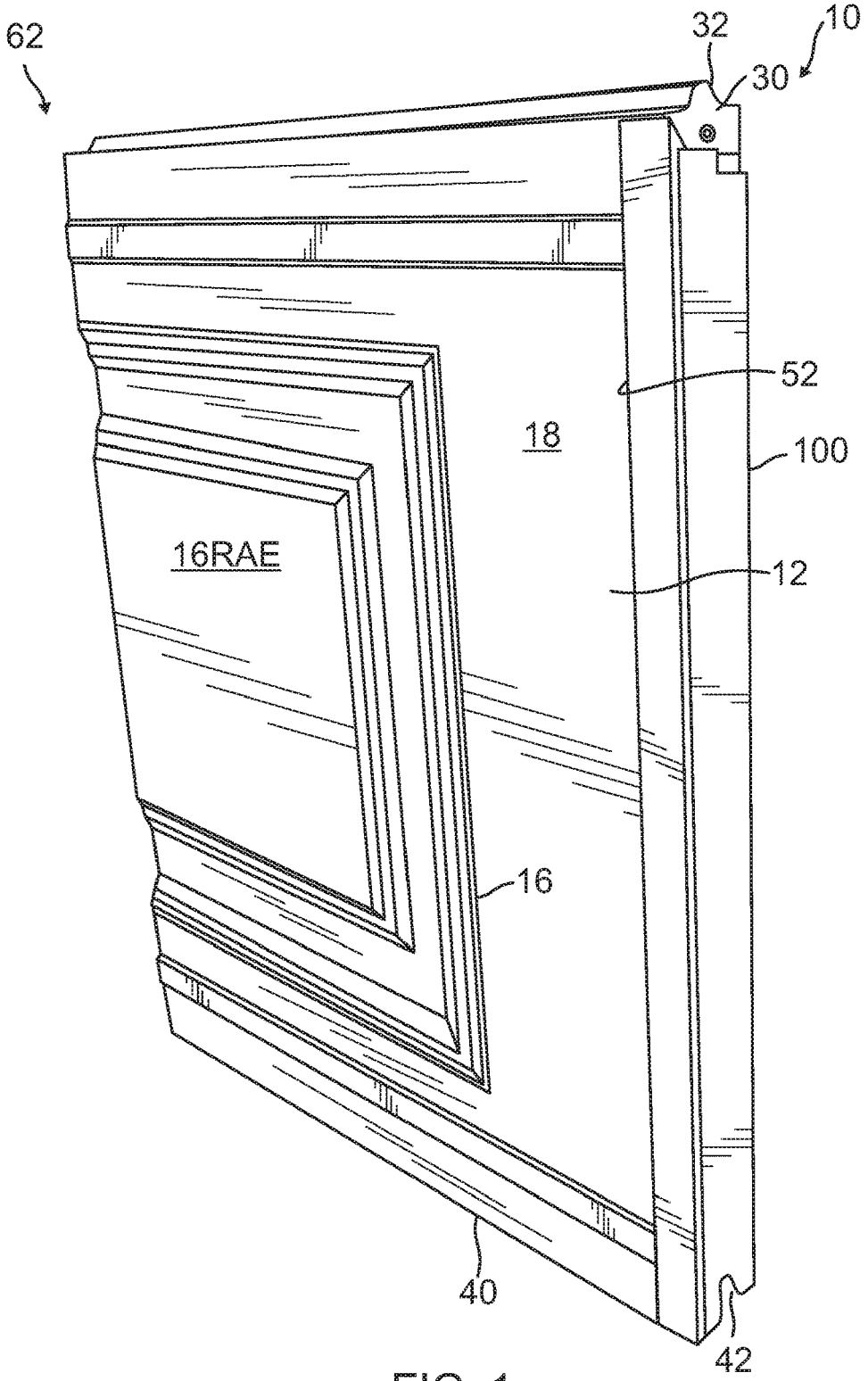
FIG. 1 is a front perspective view of a portion of a garage door panel with a second end stile on the right end of the garage door panel.

Referring to FIG. 1, there is illustrated a front perspective view of a portion of the present invention garage door panel 10 with a second end stile 100 on the right end of garage door panel 10. Garage door panel 10 has a preformed metal section 12 with at least one decorative portion 16 and which may be a multiplicity of rectangular decorative protrusions 16 on panel front surface 18. The present invention garage door panel 10 illustrated in FIG. 1, is designed to be one of a series of panels that will connect together to form a garage door 1000 (illustrated in FIG. 10). Referring to FIG. 1, preformed metal section 12 has a top portion 30 with a male section 32 and a preformed bottom section 40 with a female section 42. The male section 32 is also identified herein as a tongue section. The female section 42 is also identified herein as a groove. A male section 32 is designed to fit into a female section 42 of a second panel 310 (illustrated in FIG. 11) located along a bottom portion 40 of a preformed metal section 12.

Figure 2:
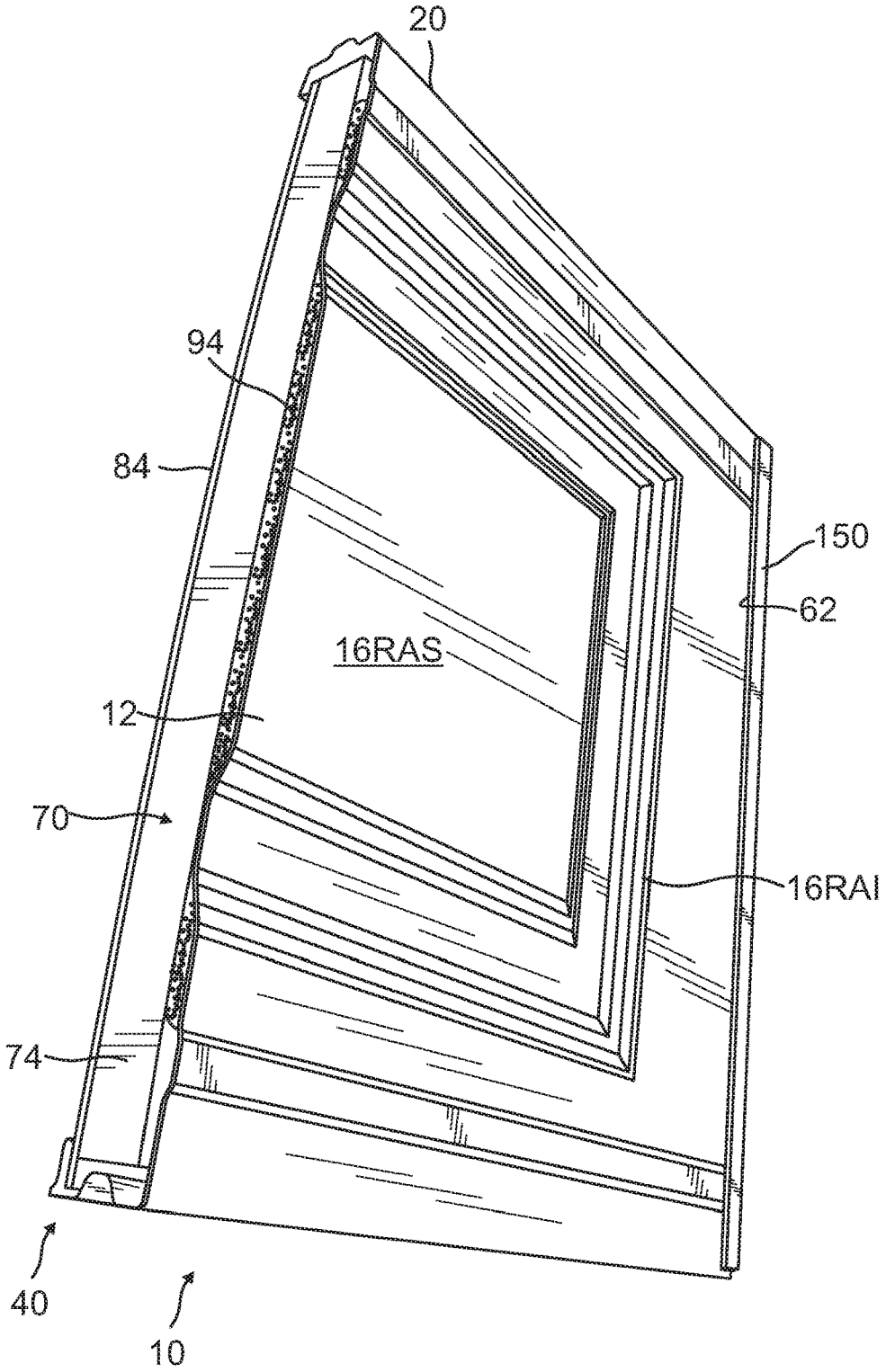
FIG. 2 is a rear perspective view of a garage door panel with a first end stile on the left end of the garage door panel and the right end exposed illustrating the internal components.
Figure 3:
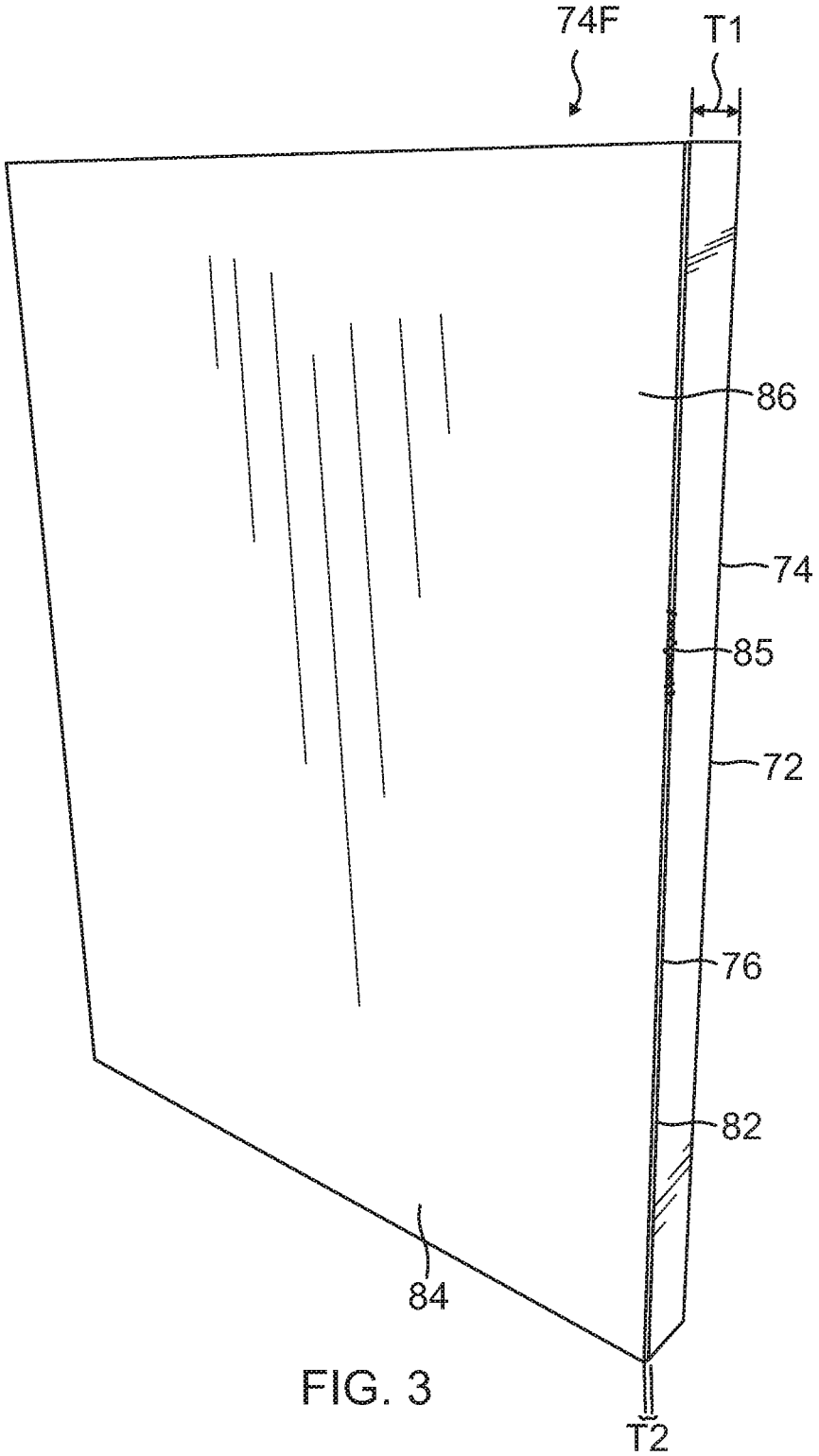
FIG. 3 is a front perspective view of a combination polystyrene section adhered to a polypropylene section.

Referring to FIG. 1 and FIG. 2, the present invention garage door panel 10 has a second end stile 100 abutting a second side 52 of said preformed metal section 12 and a first end stile 150 (illustrated in FIG. 11) abutting a first side 62 of said preformed metal section 12. The garage door panel 10, as further illustrated in FIG. 2, includes an interior chamber 70 containing a polystyrene section 74, a twin wall polypropylene section 84, and a polyurethane foam section 94. The polystyrene section 74 is located between the twin wall polypropylene section 84 and the polyurethane foam section 94. Referring to FIG. 3, it is within the spirit and scope of the present invention for the polystyrene center 74 to have a thickness "T-1" between one (1)1 inch and two (2) inches. A preferred thickness is one and one-quarter (1.25) inches. It is also within the spirit and scope of the present invention for the twin wall polypropylene section 84 to have a thickness "T-2" between 1/16th of an inch (0.0625 inches) and 1/4 of an inch (0.25 inches).

Referring to FIG. 2, polystyrene center 74 is affixed to a rear surface 14 (see FIG. 4) of preformed metal section 12 by polyurethane foam section 94. Twin wall polypropylene section 84 is affixed to polystyrene center 74 by an adhesive such as hot glue 85. To form the entire garage door, each panel 10 in a vertical column connects from a respective top portion 30 of the panel 10 to a respective adjacent bottom portion 40 of a panel 10 by a respective male section 32 interlocking with a respective adjacent female section 42.

Each garage door panel 10 is formed with the components as described above with a first end stile 150 and a second end stile 100. As will be described, intermediate stiles are be incorporated into the garage door panel 10 depending on the length of the garage door panel.

The method of forming the garage door panel 10 will now be described. The metal section 12 is pre-formed in a roll forming machine with a shape including a longitudinal wall 20 having at least one and preferably a multiplicity of decorative protrusions 16 to form the front surface 18. A first or top longitudinal side 34 is bent to form the top portion 30 with the male section 32 and a longitudinal top interior edge 35 (see FIG. 4). A second or bottom longitudinal side 44 is bent to form the bottom portion 40 with the female section 42 and a longitudinal bottom interior edge 45. The opposite side of the longitudinal wall 20 is rear surface 14. It will be appreciated that rear surface 14 is not smooth because it is opposite the front surface 18 and the stamped multiplicity of protrusions 16 extends through front surface 18 and through rear surface 14 to create raised portions 16RAE on the front surface 18 and indented portions 16RAI on the rear surface 14.

Figure 4:
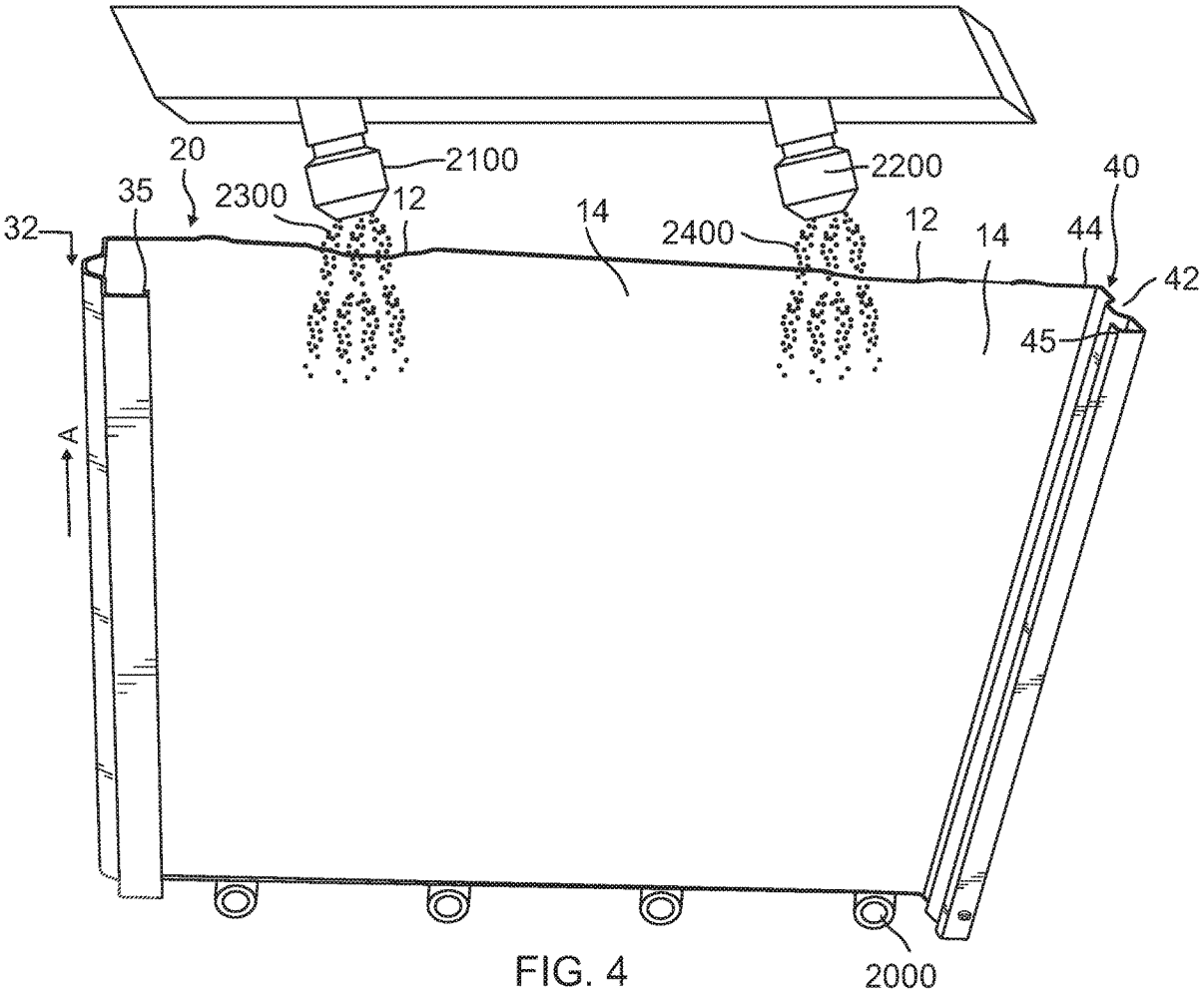
FIG. 4 is an interior perspective view of the formed metal garage door panel with spray nozzles above the interior wall and spraying compound onto the rear surface.
Figure 4A:
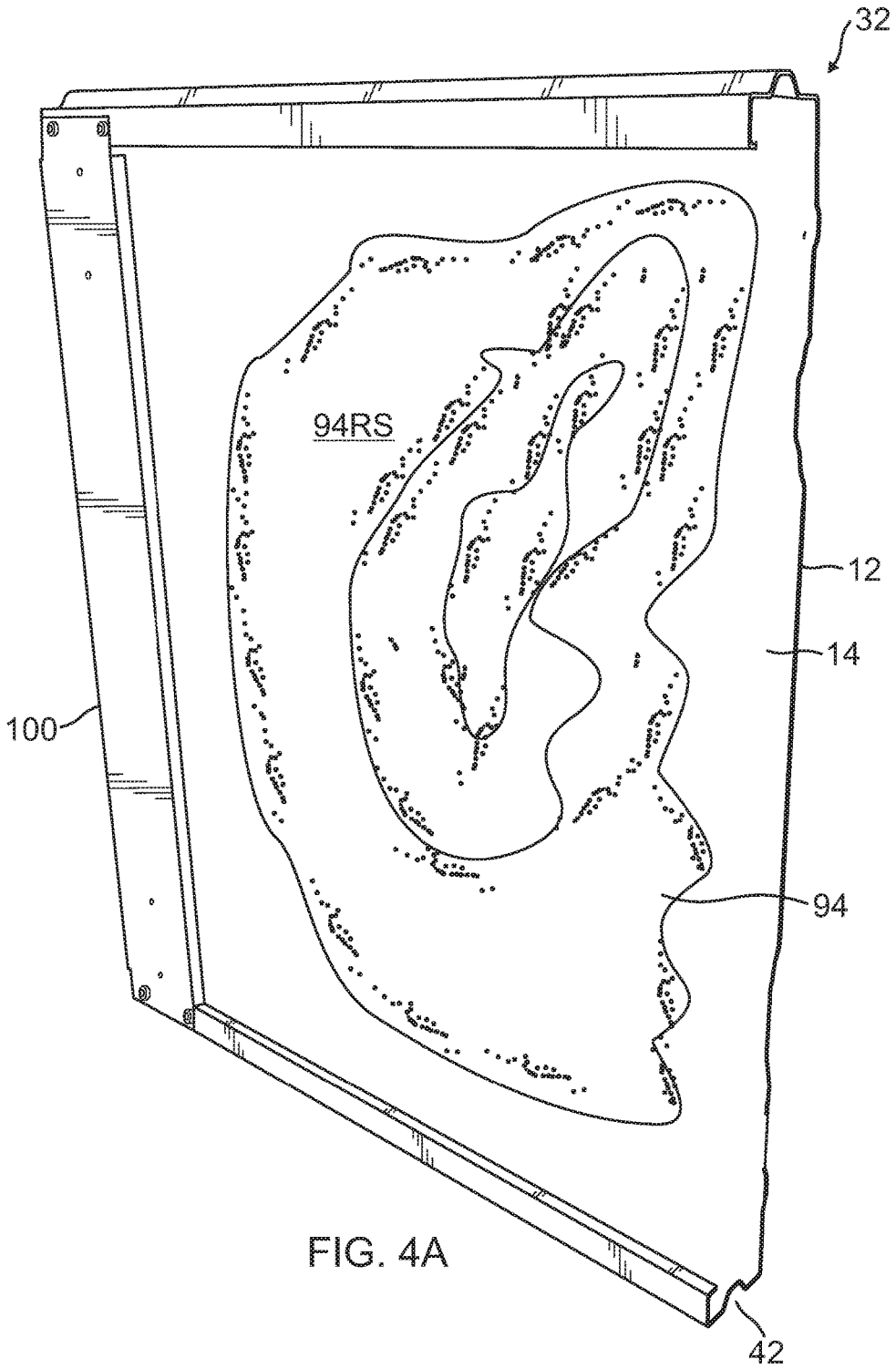
FIG. 4A is a rear perspective view of a portion of the outer metal layer of the present invention garage door panel viewed from the inside illustrating the polyurethane liquid on top of the inside portion of the outer metal layer.

The preformed metal section 12 is placed face down with front surface 18 placed onto a conveyor apparatus which can have a conveyor belt or rollers. The pre-formed metal section is preferably pre-cut to a given length "L" (See FIG. 11). This length can be any length but is typically between eight (8) feet and eighteen (18) feet. The longer the length of the present invention garage door panel 10, the more middle stiles 220 (illustrated in FIG. 9) are used. Each middle stile 220 provides additional support to prevent against deflection or bending of each panel. Referring to FIG. 4, as the length of pre-formed metal section 12 is moved on the conveyor apparatus 2000 in the direction of the arrow "A", a pair of fixed spray nozzles 2100 and 2200 above the rear surface 14 separately spray adhesive components onto the rear surface 14. Each fixed spray nozzle is in fluid communication with a separate one of the compounds. As the preformed metal section 12 travels on the conveyor apparatus, the two nozzles respectively spray a respective one of the two components which are isocyanate 2300 and polyol resin 2400 which mix onto the rear surface 14 and spread across the rear surface 14 from top section 30 to bottom section 40. The mixed combination hardens into a polyurethane foam section 94. Referring to FIGS. 2 and 4A, the polyurethane foam section 94 has a smooth rear surface 94RS as it fills in the spaces 16RAS between raised indents 16RAI and covers the raised indents 16RAI. The next step in the process is to insert the combination of the polystyrene center 74 and polypropylene section 84.

Referring to FIG. 3, there is illustrated a polystyrene section having a generally equally sized twin wall polypropylene section 84 affixed (by adhesive) 85 (see FIG. 3) to at least one side of the polystyrene section 74. The addition of the twin wall polypropylene section 84 provides additional support that would otherwise require a metal backing to adequately support the inner material from bending during movement and operation of the garage door. Further referring to FIG. 3, polystyrene section 74 has a polystyrene front surface 72 and a polystyrene rear surface 76. Similarly, polypropylene section 84 has a polypropylene front surface 82 and a polypropylene rear surface 86.

Further referring to FIGS. 3, 4 and 4A, the polystyrene section 74 and equally sized twin wall polypropylene section 84 affixed to at least one side of the polystyrene center 74 and is then placed on the preformed metal section 12 having the polypropylene section 84 facing away from said polyurethane foam section 94. Preformed metal section 12 has a metal back surface 14 that receives the two component mixture comprised of isocyanate and polyol resin in liquid form prior to the two components reacting to form the hardened polyurethane foam section 94. The transformation process from liquid to solid foam takes approximately 90 seconds to complete. During these 90 seconds, the polystyrene center 74 having the polypropylene section 84 backing is placed onto metal back surface 14 with the polystyrene section touching metal back surface 14 and the two component mixture. Simultaneously, the polystyrene section 74 having the polypropylene section 84 backing is placed and fit inside the top section 30 and the bottom section 40 of present invention garage door panel 10. In a preferred variation, the first longitudinal combination sidewall 74F is slid into and under longitudinal top interior edge 35 and the interior of top section 30 up to but not past the beginning of male section 32. The longitudinal interior bottom edge 45 is pressed away from its location spaced apart from rear surface 14 and the second longitudinal combination sidewall 74R is slid under the longitudinal interior bottom edge 45 and under bottom section 40 but not as far as groove 42 with the polystyrene front surface 72 on the polyurethane foam section 94. The polypropylene rear surface 86 acts as the rear exterior surface of the garage door panel 10.

Figure 5:
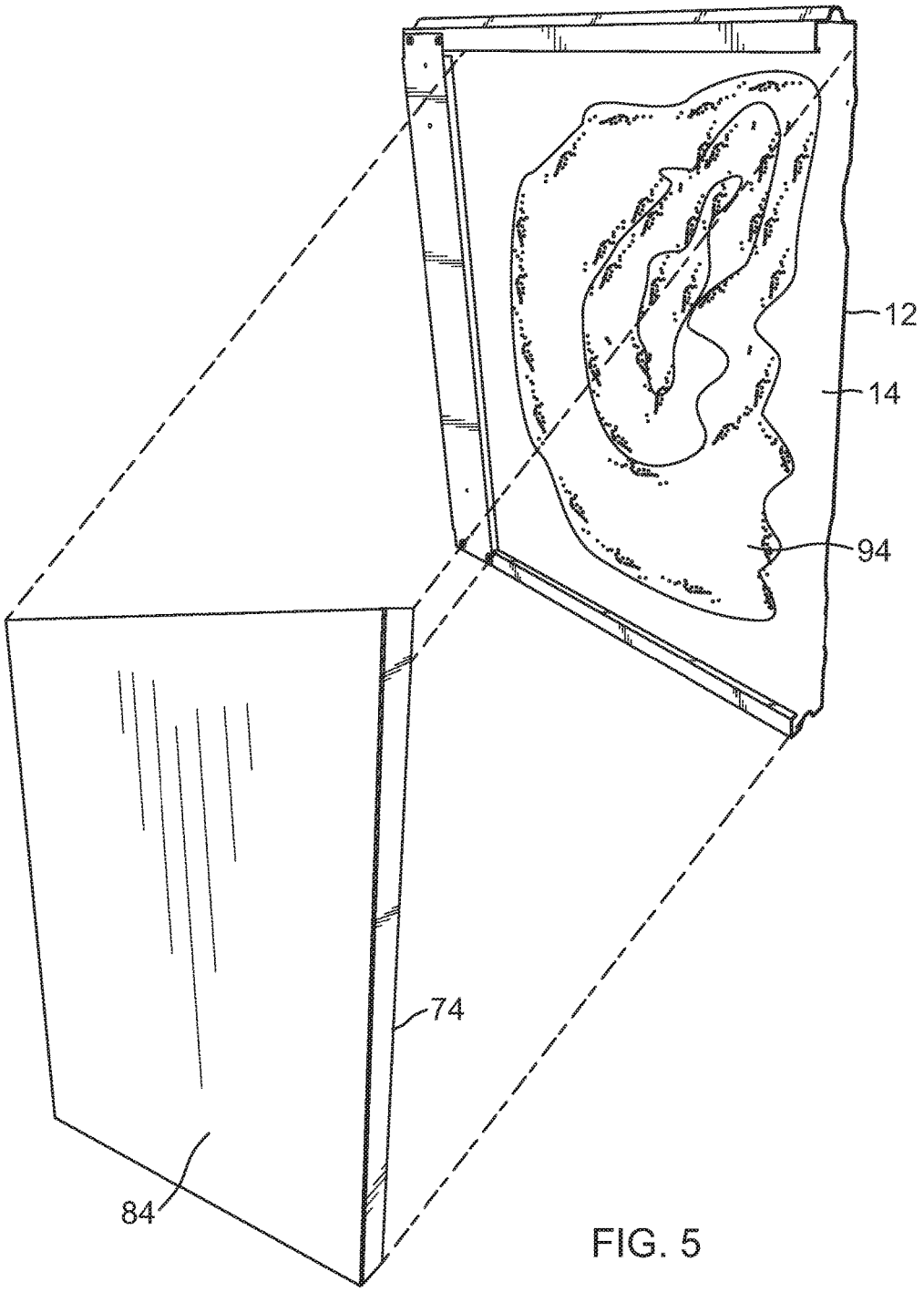
FIG. 5 is an exploded view illustrating the outer metal layer of the present invention garage door panel view from the inside illustrating the polyurethane liquid on top of the inside portion of the outer metal layer and the polystyrene center and the twin wall corrugated polypropylene section prior to being affixed to the interior of the outer metal layer.

Referring to FIG. 5, the placement of the polystyrene center 74 having the polypropylene section 84 backing is illustrated in an exploded view during the 90 seconds after the two component mixture has been applied and prior to the placement of the polystyrene center 74 onto metal back surface 14 of preformed metal section 12.

Figure 6:
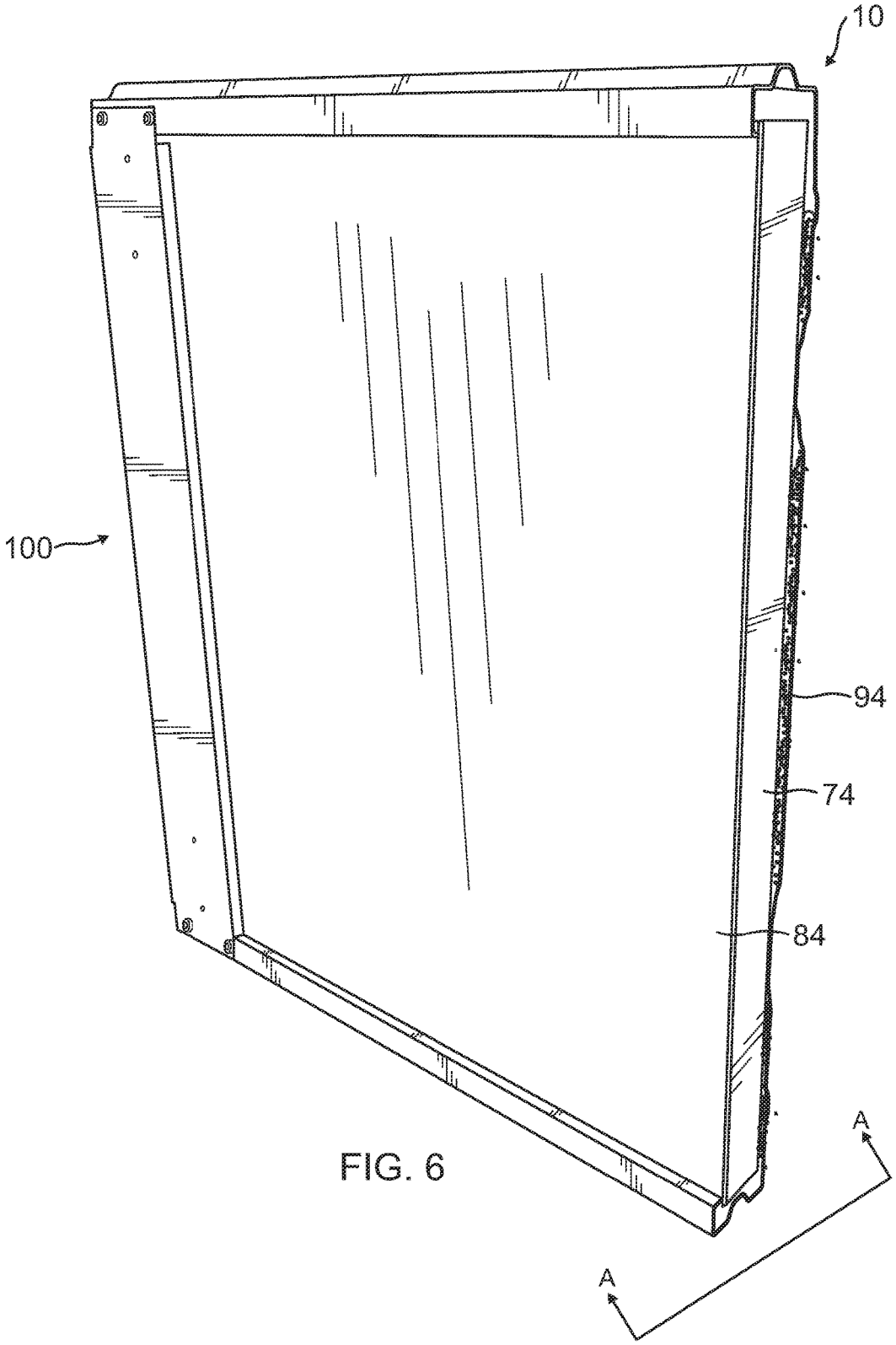
FIG. 6 is a rear perspective view of the present invention garage door panel illustrating the polystyrene section affixed between the twin wall corrugated polypropylene section and the polyurethane foam section.

Illustrated in FIG. 6, is a rear view of the present invention garage door panel 10 after the placement as described in detail above has occurred and with only one end stile 100 attached. After approximately 90 seconds has passed the two component mixture (typically of isocyanate and polyol resin) hardens to form a solid polyurethane foam section 94 that bonds preformed metal section 12 to the polystyrene center 74.

Figure 7:
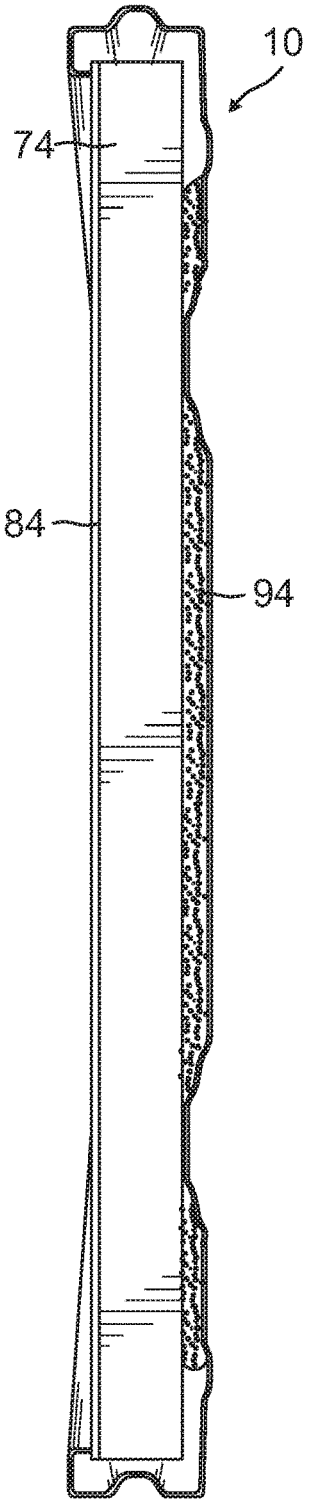
FIG. 7 is a cross sectional view of the present invention garage door panel illustrating the polystyrene center affixed between the twin wall corrugated portion and the polyurethane foam section.

Referring to FIG. 7, there is illustrated a cross sectional view of the present invention garage door panel 10 taken along section A-A as shown in FIG. 6. The two component mixture expands and hardens into the polyurethane foam section 94 to create a rigid, monolithic panel that not only provides insulation and stability but is lightweight as well. This is an innovation over the prior art by providing a monolithic structure that does not require metal on both sides. As illustrated in FIG. 7, the polystyrene section 74 is located between and affixed to the polypropylene section 84 on one side and the polyurethane foam section 94 on the opposite side.

Figure 8:
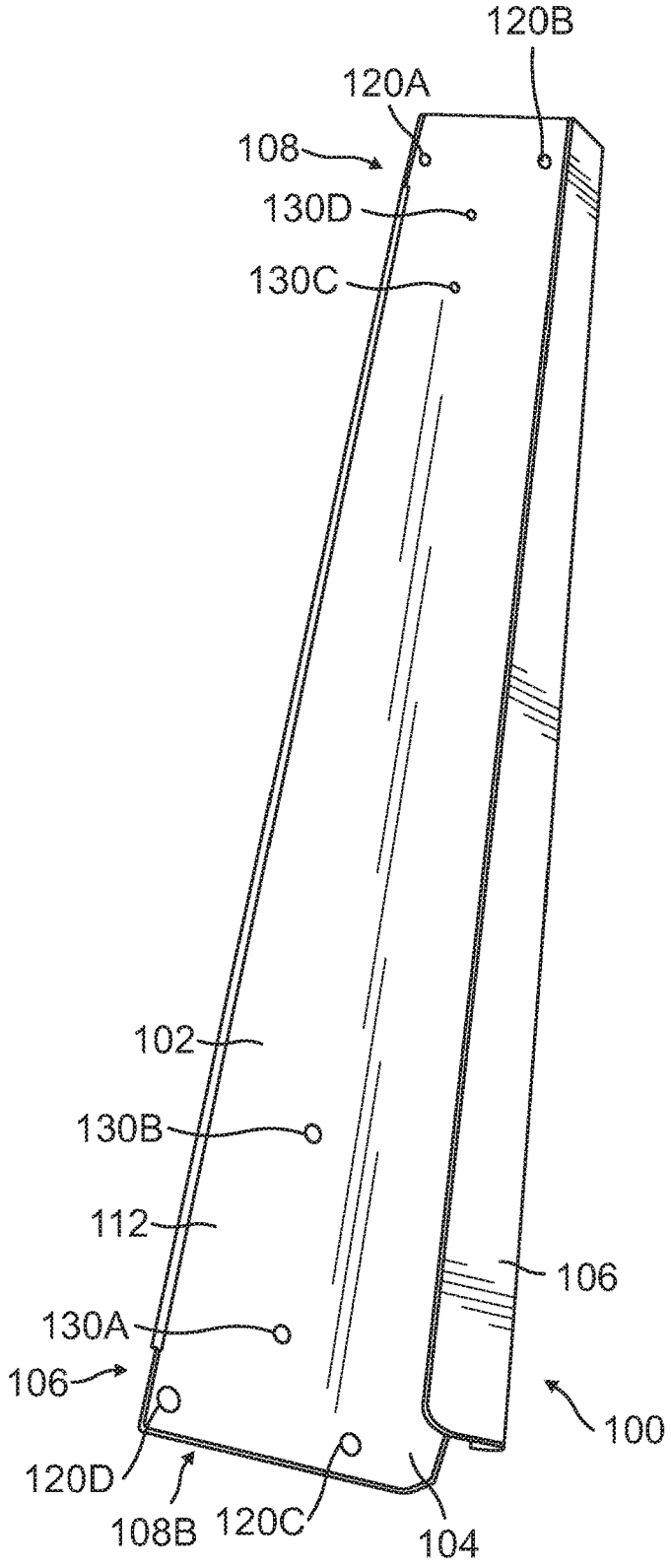
FIG. 8 is a rear perspective view of an end stile.

Referring to FIG. 8, there is illustrated an end stile 100 having a stile first vertical wall 102, a stile second vertical wall 104, and a stile third vertical wall 106. All three stile vertical walls meet at approximately 90 degree angles to form an end stile having a general L shaped cross section. End stile first vertical wall 102 has a first wall front surface 112 having four rivet holes (120AA, 120BB, 120CC, and 120DD) that accepts rivets or screw or other similar standard affixing members to enter through the four vertical holes to attach end stile 100 to preformed metal section 12. Two of the rivet holes (120AA and 120BB) are located near stile top portion 108T and two rivet holes (120CC and 120DD) are located near stile bottom portion 108B. The four rivet holes working collectively together allow the a fixing member such as a rivet or screw to affix end stile 100 onto preformed metal section 12.

Referring to FIG. 8, similarly but for a different purpose, there are 4 hinge holes (130AA, 130B, 130CC, and 130DD) that are used to attach hinges to each of the stiles. The hinges allow the garage door panels to pivot or rotate as the garage door moves up or down along a track.

Figure 9:
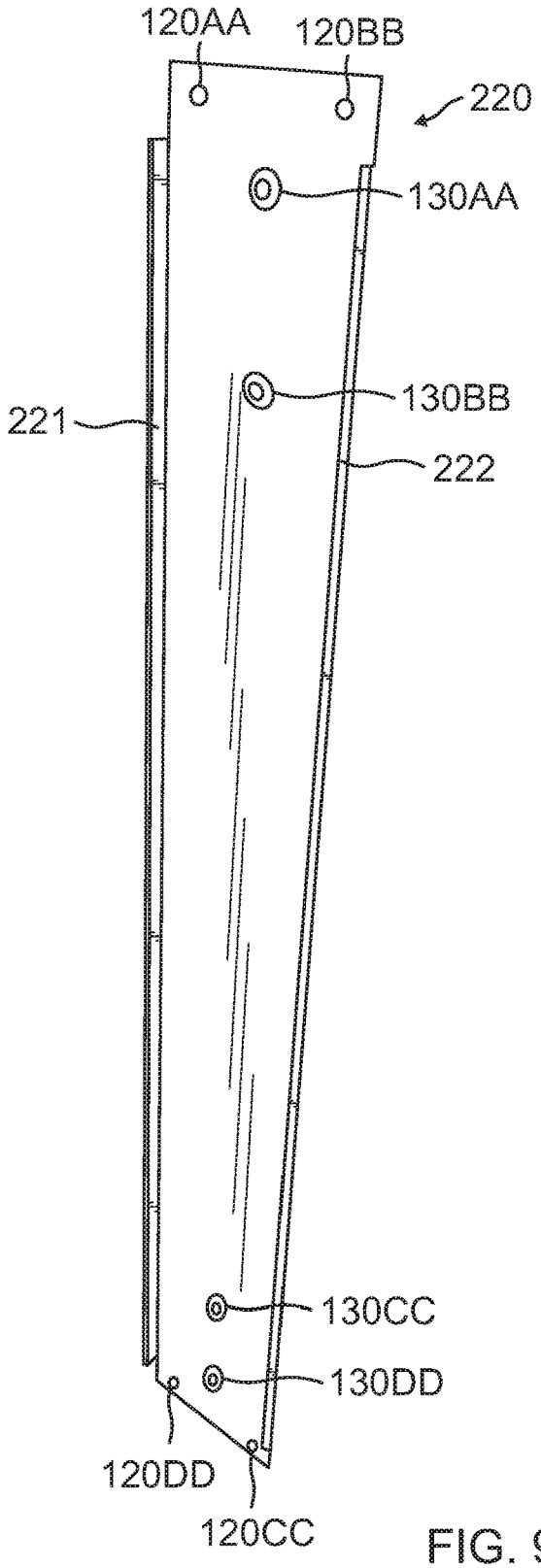
FIG. 9 is a rear perspective view of a middle stile.

Referring to FIG. 9, there is illustrated a middle stile 220 which is placed at intervals between a first end stile 100 and a second end stile 150. Typically for a panel that is eight (8) feet in length there are two end stiles and one middle stile used in the center. For a panel that is ten (10) feet in length there are two middle stiles used and for a panel that is fourteen (14) feet there are three middle stiles used. Regardless of the panel length two end stiles are used. The middle stile 220 has transverse walls 221 and 222 to accommodate for the thickness of the top and bottom end sections and the rear surface of the polystyrene section 84.

Figure 10:
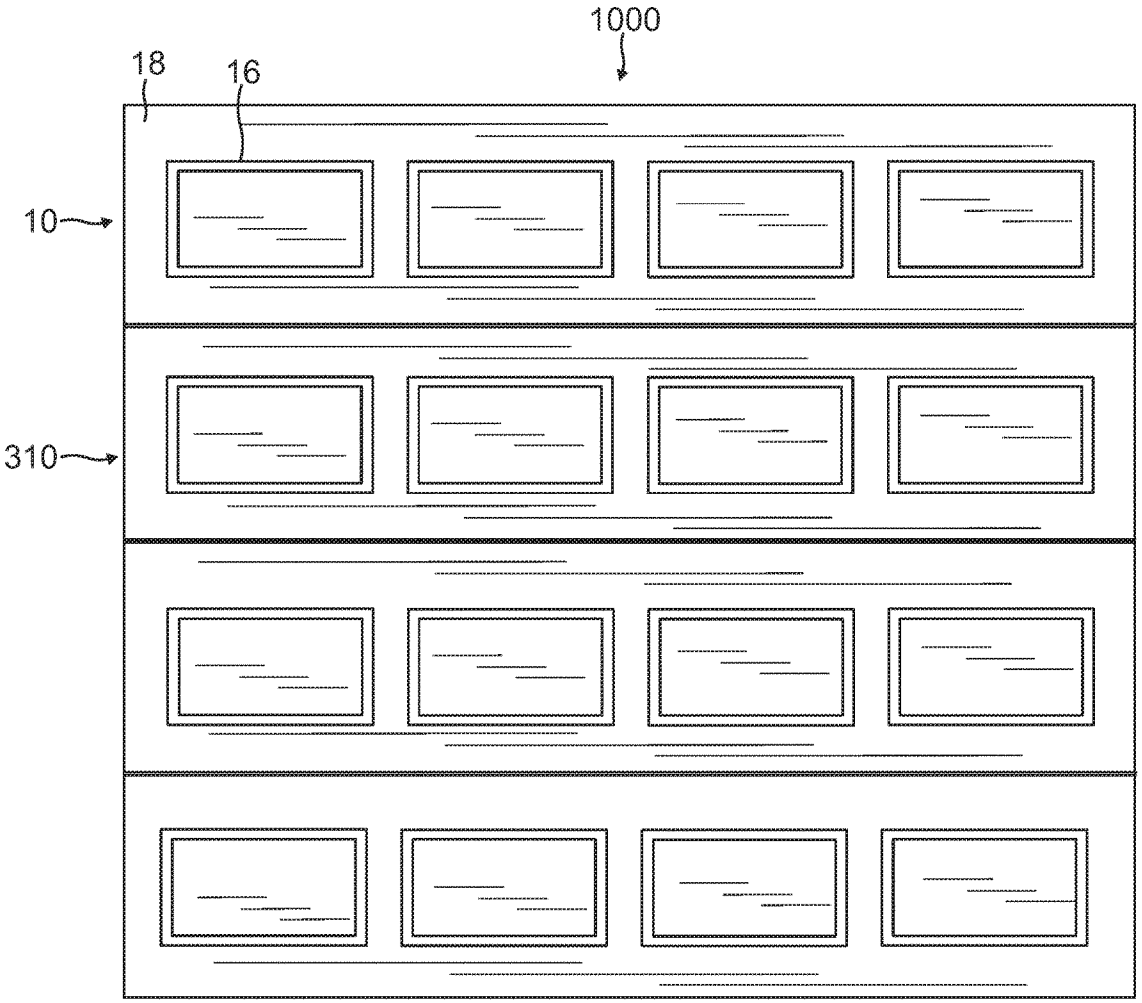
FIG. 10 is a front perspective view of an entire garage door using four (4) of the present invention garage door panels.

Referring to FIG. 10, there is illustrated a front view of an entire garage door 1000 comprised of four (4) of the present invention garage door panels 10. From this front view the rectangular decorative indents 16 on panel front surface 18 are viewable.

Figure 11:
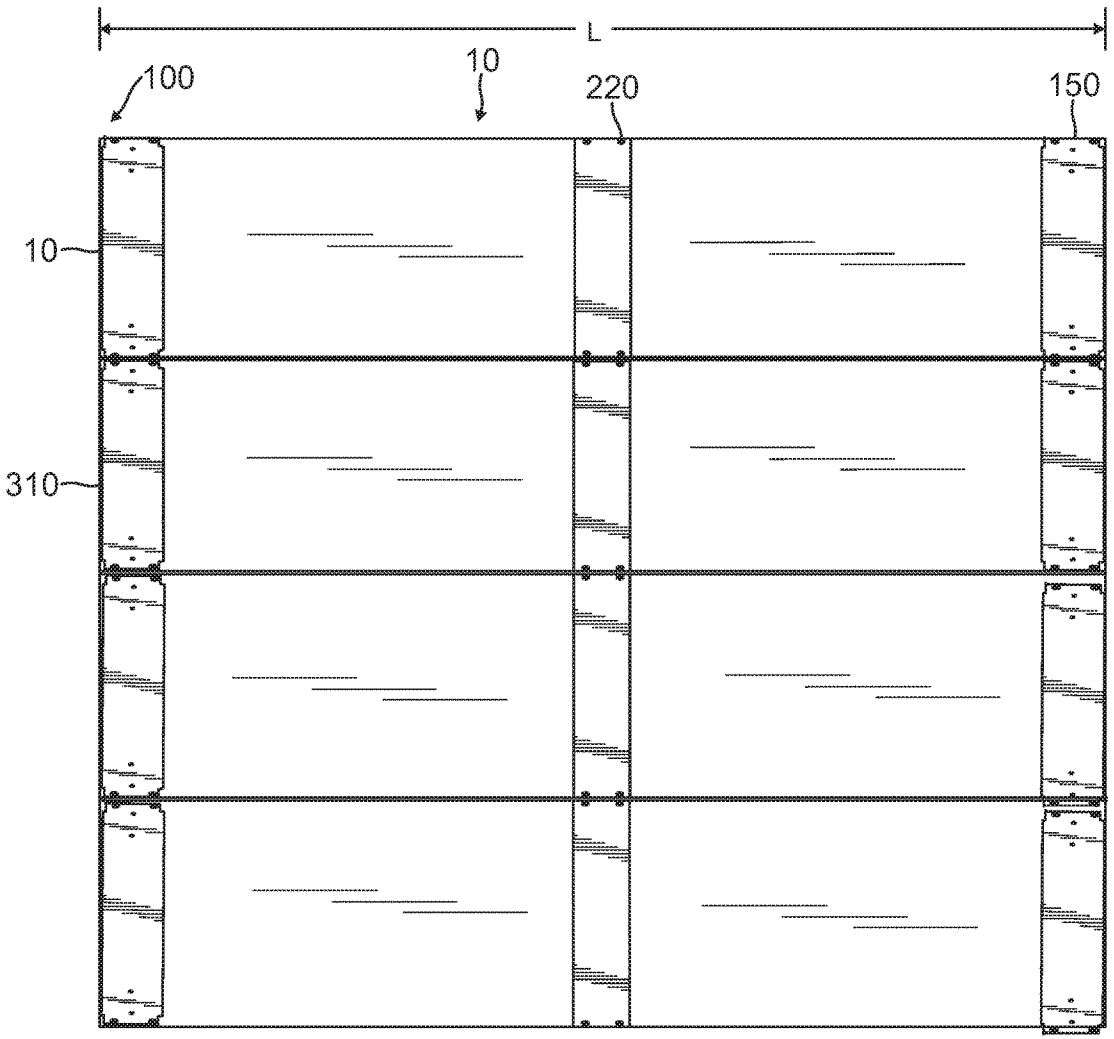
FIG. 11 is a rear perspective view of an entire garage door using four (4) of the present invention garage door panels vertically aligned and not showing to tongue on the top panel.

Referring to FIG. 11, there is illustrated a rear view of a portion of four (4) garage door panels 10 each of which is only eight (8) feet wide comprised of four (4) of the present invention garage door panels 10 but not illustrating the top male portion 32 on the uppermost panel. The garage door panes 10 each have a length of only eight (8) feet. Therefore, only one middle stile 220 was used. As previously stated, for a longer panel section more middle stiles would be used to add additional strength and prevent deflection of the panel.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A garage door panel comprising:

a. a pre-formed metal section having a front surface and a rear surface, at least one decorative portion indented into the front surface leaving raised areas on the rear surface, the formed metal section including a top longitudinal side including a top portion with a male tongue, a bottom longitudinal side including a bottom portion with a female groove, a first transverse end and a second transverse end;

b. a polystyrene section having a front surface and a rear surface and an identically sized and shaped twin wall polypropylene section having a front surface and a rear surface, the front surface of the twin wall polypropylene section affixed to the rear surface of the polystyrene section to form a combination insert;

c. the rear surface of the pre-formed metal section coated with a hardened polyurethane foam section, the combination insert retained within a portion of the pre-formed metal section with the front surface of the polystyrene section retained against the polyurethane foam section and the rear surface of the twin wall polypropylene section forming a rear surface of the garage door panel; and d. a first metal stile affixed onto the first transverse end of the pre-formed metal section and retained combination insert and a second metal stile affixed onto the second transverse end of the pre-formed metal section.

2. The garage door panel in accordance with claim 1, further comprising:

a. the first metal stile affixed onto the top portion of the top longitudinal side adjacent the first transverse end and affixed onto the bottom portion of the bottom longitudinal side adjacent the first end; and b. the second metal stile affixed onto the top portion of the top longitudinal side adjacent the second transverse end and affixed onto the bottom portion of the bottom longitudinal side adjacent the second end.

3. The garage door panel in accordance with claim 1, further comprising: at least one intermediate metal stile affixed to the top portion of the top longitudinal side and affixed to the bottom portion of the bottom longitudinal side at a location between the first metal stile and the second metal stile.

4. The garage door panel in accordance with claim 1, further comprising: said hardened polyurethane foam is a combination of isocyanate and polyol resin.

5. The garage door panel in accordance with claim 1, further comprising: said male tongue is configured to retain a groove identical to said female groove.

6. The garage door panel in accordance with claim 1, further comprising: said female groove is configured to be inserted into a male tongue identical to said male tongue.

7. The garage door panel in accordance with claim 1, further comprising: said garage door panel has a length between 7.0 feet and 20.0 feet.

8. The garage door panel in accordance with claim 1, further comprising: said garage door panel has at least two end stiles and at least one middle stile.

9. The garage door panel in accordance with claim 1, further comprising: said twin wall polypropylene section is between 0.0625 inches thick and 0.25 inches thick.

10. The garage door panel in accordance with claim 1, further comprising: said polystyrene section has a thickness between 1.0 inch and 2.0 inches.

11. A garage door panel comprising:

a. a pre-formed metal section having a front surface and a rear surface, at least one decorative portion in the front surface, the formed metal section including a top longitudinal side including a top portion with a male retaining member, a bottom longitudinal side including a bottom portion with a female receiving member, a first transverse end and a second transverse end;

b. a polystyrene section having a front surface and a rear surface and a correspondingly sized and shaped twin wall polypropylene section having a front surface and a rear surface, the front surface of the twin wall polypropylene section affixed to the rear surface of the polystyrene section to form a combination insert; and c. the rear surface of the pre-formed metal section coated with a hardened polyurethane foam section, the combination insert retained within a portion of the pre-formed metal section with the front surface of the polystyrene section retained against the hardened polyurethane foam section and the rear surface of the twin wall polypropylene section forming a rear surface of the garage door panel.

12. The garage door panel in accordance with claim 11, further comprising:

a. a first metal stile affixed onto the top portion of the top longitudinal side adjacent the first transverse end and affixed onto the bottom portion of the bottom longitudinal side adjacent the first end; and b. a second metal stile affixed onto the top portion of the top longitudinal side adjacent the second transverse end and affixed onto the bottom portion of the bottom longitudinal side adjacent the second end.

13. The garage door panel in accordance with claim 12, further comprising: at least one intermediate stile affixed to the top portion of the top longitudinal side and affixed to the bottom portion of the bottom longitudinal side at a location between the first metal stile and the second metal stile.

14. The garage door panel in accordance with claim 11, further comprising: said hardened polyurethane foam is a combination of isocyanate and polyol resin.

15. A method of forming a garage door panel comprising:

a. forming a flat rectangular section of metal having a top longitudinal side, a bottom longitudinal side, a first transverse end and a second transverse end, a front surface and a rear surface into a pre-formed garage door metal section by creating at least one decorative portion on the front surface, bending the top longitudinal side into a top portion with a male retaining member extending from the first transverse end to the second transverse end, and bending the bottom longitudinal side including a bottom portion with a female receiving member extending from the first transverse end to the second transverse end;

b. placing the pre-formed metal section front surface down onto a conveyor apparatus with the conveyor apparatus moving the pre-formed metal section in a longitudinal direction from the second transverse end to the first transverse end, a pair of fixed spray nozzles above the rear surface separately respectively spraying liquid isocyanate and liquid polyol resin to form two-component mixture onto said rear surface of said pre-formed metal section and spread across the rear surface from top section to bottom section, the two-component mixture of liquid isocyanate and liquid polyol resin spread onto said rear surface of said pre-formed metal section hardens into a polyurethane foam section in less than ninety (90) seconds;

c. forming a combination insert including a polystyrene section having a front surface and a rear surface and separately forming a twin wall polypropylene section having a front surface and a rear surface, the front surface of the twin wall polypropylene section adhered to the rear surface of the polystyrene section; and d. during this ninety (90) seconds while the liquid isocyanate and liquid polyol resin mix to create the polyurethane foam section, placing the combination insert with the front surface of the polystyrene section placed onto the liquid isocyanate and polyol glycol with the combination insert retained by the polyvinyl foam and the combination insert slid into and under a longitudinal top interior edge and the interior of top section up to but not past a beginning of male engaging member and a longitudinal interior bottom edge is pressed away from its location spaced apart from the rear surface of the metal section and the combination insert is slid under said longitudinal interior bottom edge and under the bottom section but not as far as female receiving member, the twin wall polypropylene surface being a rear exterior surface of the garage door panel.

16. The method of forming a garage door panel in accordance with claim 15, further comprising:

a. determining a desired length for the garage door panel and making a transverse cut through the metal backing and retained combination insert to create a first end of the garage door panel, a remote end forming the second end of the garage door panel;

b. affixing a first metal stile onto the top portion of the top longitudinal side adjacent the first transverse end and onto the bottom portion of the bottom longitudinal side adjacent the first end; and c. affixing a second metal stile onto the top portion of the top longitudinal side adjacent the second transverse end and onto the bottom portion of the bottom longitudinal side adjacent the second end.

17. The method of forming a garage door panel in accordance with claim 16 where the garage door panel is at least eight (8) feet long, the method further comprising: affixing one (1) intermediate metal stile to the top portion of the top longitudinal side and to the bottom portion of the bottom longitudinal side at a location between the first metal stile and the second metal stile.

18. The method of forming a garage door panel in accordance with claim 16, where the garage door panel is at least ten (10) feet long, the method further comprising: affixing two (2) spaced apart intermediate metal stiles with each respective intermediate stile affixed to the top portion of the top longitudinal side and to the bottom portion of the bottom longitudinal side at a location between the first metal stile and the second metal stile.

19. The method of forming a garage door panel in accordance with claim 16, where the garage door panel is at least fourteen (14) feet long, the method further comprising: affixing three (3) spaced apart intermediate metal stiles with each respective intermediate stile affixed to the top portion of the top longitudinal side and to the bottom portion of the bottom longitudinal side at a location between the first metal stile and the second metal stile.

20. The method of forming a garage door panel in accordance with claim 16, further comprising:

a. forming the male engaging member in the shape of a tooth;

b. forming the female receiving member in the shape of a groove; and c. the female groove is configured to be inserted into a male tongue identical to said male tongue.

* * * * *